US006148692A

United States Patent [19]

Russell

[11] Patent Number: 6,148,692

[45] Date of Patent: Nov. 21, 2000

[54] JAR LID LOOSENING DEVICE

[76] Inventor: Jerry E. Russell, HC 3, Box 628, Kimberling City, Mo. 65686

[21] Appl. No.: 09/385,619

[22] Filed: Aug. 30, 1999

Related U.S. Application Data

[60] Provisional application No. 60/098,446, Aug. 31, 1998.

[51] Int. Cl.[7] ..... B67B 7/00

[52] U.S. Cl. ..... 81/3.2; 81/3.25

[58] Field of Search ..... 81/3.2, 3.25, 3.32

[56] References Cited

U.S. PATENT DOCUMENTS

| | | | |
|---|---|---|---|
| 2,897,699 | 8/1959 | Anderson . | |
| 3,158,879 | 12/1964 | Barrett . | |
| 3,795,158 | 3/1974 | Morita | 81/3.32 |
| 3,812,742 | 5/1974 | Polasek . | |
| 3,950,801 | 4/1976 | Morrison . | |
| 4,171,650 | 10/1979 | Cardinal . | |
| 4,718,312 | 1/1988 | Jones . | |
| 4,762,029 | 8/1988 | Chen . | |
| 4,833,948 | 5/1989 | Jones . | |
| 4,852,431 | 8/1989 | Frangel . | |
| 4,919,014 | 4/1990 | Chen et al. | 81/3.2 |
| 5,003,844 | 4/1991 | Barrow . | |
| 5,167,172 | 12/1992 | Heebner . | |
| 5,207,125 | 5/1993 | Pierce, Jr. et al. . | |
| 5,271,296 | 12/1993 | Parent et al. . | |
| 5,301,433 | 4/1994 | Rogers . | |
| 5,370,019 | 12/1994 | Sartell et al. . | |
| 5,430,923 | 7/1995 | Parent et al. . | |
| 5,617,765 | 4/1997 | Bennett . | |
| 5,996,441 | 12/1999 | Bateman | 81/3.2 |

*Primary Examiner*—Timothy V. Eley
*Assistant Examiner*—Dung Van Nguyen
*Attorney, Agent, or Firm*—Jonathan A. Bay

[57] ABSTRACT

The jar lid loosening device includes a pair of jaws which are arranged to compress upon a lidded jar inserted therebetween. Of the pair of jaws, one jaw is a passive jaw and the other is the active jaw. The passive jaw is fixed substantially stationary and hence it neither twists nor travels in compression or retraction. The active jaw, in contradistinction. is given compound motion. More particularly, the active jaw is mounted in a traveling head. The traveling head is arranged to cycle through compression and retraction strokes. The active jaw is carried in the traveling head such that, generally, the active jaw rides passively along with the traveling head through the compression and retraction strokes. If however, a lidded jar is inserted between the jaws, then during a compression stroke the active jaw eventually limits out against the lidded jar. From then on, the lidded jar is subjected to increasing compression between the jaws by virtue of the traveling head. More significantly, the active jaw is coupled to the traveling head such that upon contact with the lidded jar—and increasing compression from the traveling head—the active jaw is driven into a twisting stroke. The relative twisting between the active and passive jaws causes the lid to loosen on the jar. The device-loosened lid may then be handily removed after that.

20 Claims, 4 Drawing Sheets

JAR LID LOOSENING DEVICE

CROSS-REFERENCE TO PROVISIONAL APPLICATION(S)

This application claims the benefit of U.S. Provisional Application Ser. No. 60/098,446, filed Aug. 31, 1998.

BACKGROUND AND SUMMARY OF THE INVENTION

The invention generally relates to closure-removing tools for receptacles and, more particularly, to ajar lid loosening device.

Briefly, the jar lid loosening device in accordance with the invention includes a pair of jaws which are arranged to compress upon a lidded jar inserted therebetween. Of the pair of jaws, one jaw is a passive jaw and the other is the active jaw. The passive jaw is fixed substantially stationary and hence it neither twists nor travels in compression or retraction. The active jaw, in contradistinction, is given compound motion. More particularly, the active jaw is mounted in a traveling head. The traveling head is arranged to cycle through compression and retraction strokes. The active jaw is carried in the traveling head such that, generally, the active jaw rides passively along with the traveling head through the compression and retraction strokes. If however, a lidded jar is inserted between the jaws, then during a compression stroke the active jaw eventually limits out against the lidded jar. From then on, the lidded jar is subjected to increasing compression between the jaws by virtue of the traveling head. More significantly, the active jaw is coupled to the traveling head such that upon contact with the lidded jar—and increasing compression from the traveling head—the active jaw is driven into a twisting stroke. The relative twisting between the active and passive jaws causes the lid to loosen on the jar. The device-loosened lid may then be handily removed after that.

More particularly, these and other objects are provided according to the invention in a jar lid loosening device that comprises aspects of the following. It has a relatively stationary base, a traveling head, and an upright carrier post anchored to the base and provided for carrying the traveling head for cycles of DOWN (compression) and UP (retraction) strokes relative to the base.

A source of power is provided to power the traveling head through at least the DOWN or compression stroke. In one embodiment of the invention, the source of power is an electric motor. That way, the upright carrier post is an upright threaded drive rod which electric motor turns. The traveling head includes a threaded socket for engaging the threaded drive rod. Optionally the motor is reversible. In an alternate embodiment of the invention, the source of power is a hand jack. According to this way, the upright carrier post is an upright toothed-stanchion for operative engagement by the hand jack. The traveling head for this embodiment includes a socket for passage of the stanchion.

The jar lid loosening device further includes a pair of jaws which are arranged in opposition to each other to close or compress upon a lidded jar inserted therebetween. One of said jaws is a passive jaw that is fixed substantially stationary relative to the base and hence neither twists nor travels axially relative to the base. The other jaw can be reckoned as an active jaw that is spaced above the passive jaw as mounted in the traveling head.

A converter mechanism is incorporated in the traveling head to link the active jaw therewith and harness the traveling head's DOWN stroke as a drive input for conversion into a twisting motion in the active jaw.

That way, generally, the active jaw rides along inactively or at rest with the traveling head as the traveling head powers through a given DOWN or compression stroke. Except that, if a lidded jar is inserted between the closing jaws, then as the active jaw eventually limits out against the lidded jar during the given compression stroke, from that stage on, the lidded jar is subjected to increasing compression between the jaws by virtue of the powered DOWN stroke of the traveling head concurrently while the converter mechanism converts the DOWN-stroke drive input from the traveling head into a twisting motion in the active jaw.

Consequently, the lidded jar is subjected to such relative twisting under increasing compression between the twisting active jaw and the stationary passive jaw that the jar and lid progressively loosen apart until the device-loosened lid may be handily removed after that. Optionally, the converter mechanism comprises, in combination, ● configuring the traveling head non-rotatably with one of abutments or complementary inclined ramp-ways, ● configuring the active jaw with the other of said abutments or complementary inclined ramp-ways, and ● arranging the abutments to engage the inclined ramp-ways such that, at the stage of the given DOWN stroke when the active jaw limits out against the lidded jar, further downward travel of the traveling head applies the previously-mentioned rotational force to the active jaw.

The abutments can take the form of any sort of prong. Prongs includes pins and the like. The inclined ramp-ways are optionally formed in a cylindrical sleeve such that the inclined ramp-ways trace helical arc segments.

The converter mechanism optionally further includes an open coil compression spring loaded between the active jaw and traveling head to oppose both axial and torsional changes in relative position therebetween.

It is preferred if the active jaw is recessed from below in the shape of a spherical cap for improving universal mating with a cylindrical rim of various sizes for variously-sized lidded jars. It is further preferred if one or both of the jaws incorporate a resilient outer layer to improve frictional gripping on lidded jars.

Additional aspects and objects of the invention will be apparent in connection with the discussion further below of preferred embodiments and examples.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the appended claims. In the drawings.

DETAILED DESCRIPTION OF THE PREFERRED EMBODIMENTS

Figure 1:
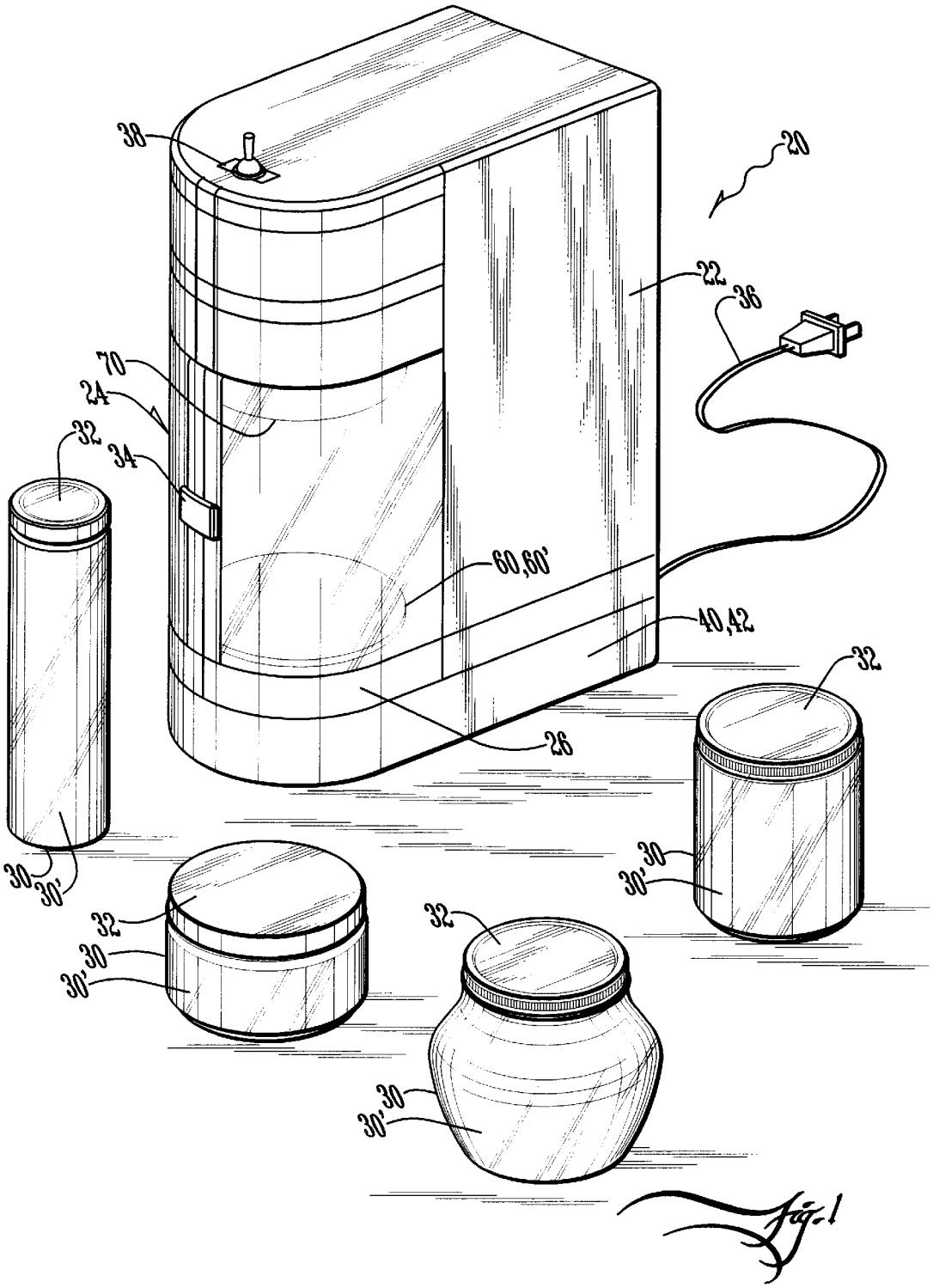
FIG. 1 is a perspective view of a motorized version of jar lid loosening device in accordance with the invention, shown surrounded by a variety of jars and bottles and the like to illustrate the operative use environment for the invention.
Figure 6:
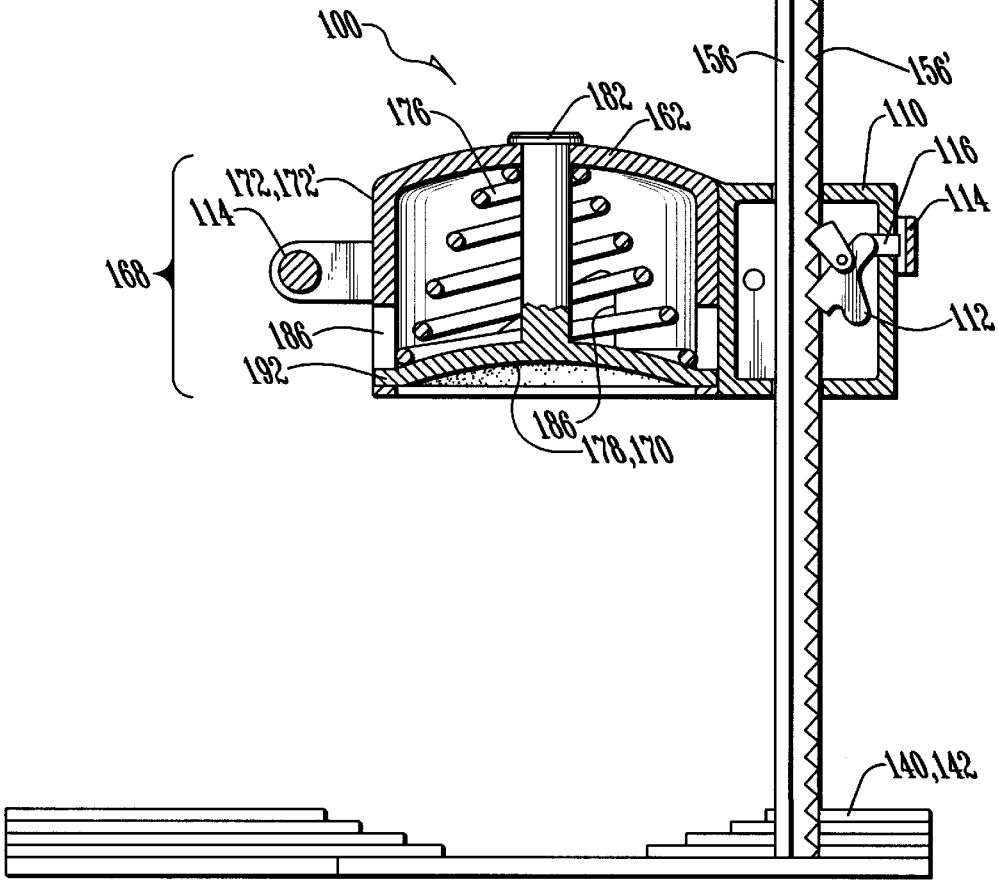
FIG. 6 is a side elevational view of a hand-jack version of the jar lid loosening device in accordance with the invention, shown partly in section as taken along a vertical plane of symmetry thereof; and, FIG. 7 is a plan view thereof, with portions shown in dashed lines and other portions removed.

FIG. 1 is a perspective view of a motorized version 20 of a jar lid loosening device in accordance with the invention. For comparison, FIG. 6 shows a hand-jack version 100, which will be more particularly described further below.

Continuing in FIG. 1, the jar lid loosening device 20 is shown adorned in an appliance-style product configuration 22 suitable for consumer use as an appliance on a home counter-top. This appliance-style product configuration includes a case 22 having a front-end compartment 24 closed off by transparent plastic doors 26. The appliance 22 is surrounded by a variety of lidded jars and bottles 30 capped by screwed down lids 32. It is an object of the invention to provide a mechanical advantage in loosening tightly screwed-down lids for those unable to do so manually tor themselves. The elderly and infirm are two common groups of persons who commonly find problems with lids on jars or bottles being more tightly screwed down than their own strength can unstick. Whereas the drawing shows an odd assortment of glass jars and bottles 30', the invention is adaptable for loosening the closure of any receptacle which twists off. Accordingly, the depiction of glass bottles and jars 30' only is given here for convenience in this disclosure and is given by way of non-limiting example. Also, the odd assortment of sizes is included to show likewise by way of non-limiting example that the jar lid loosening device 20 is useful for working on receptacles of a variety of sizes, and not just those specifically illustrated.

The doors 26 that close off the front-end compartment 24 include a safety switch 34 which breaks or OPEN's the power circuit 36 unless the doors 26 are completely closed. That way the power circuit 36 allows completion only if the doors 26 are closed. On top of the compartment 24 there is a three-way switch 38 allowing manual control over the functions of the jar lid loosening device 20.

Figure 2:
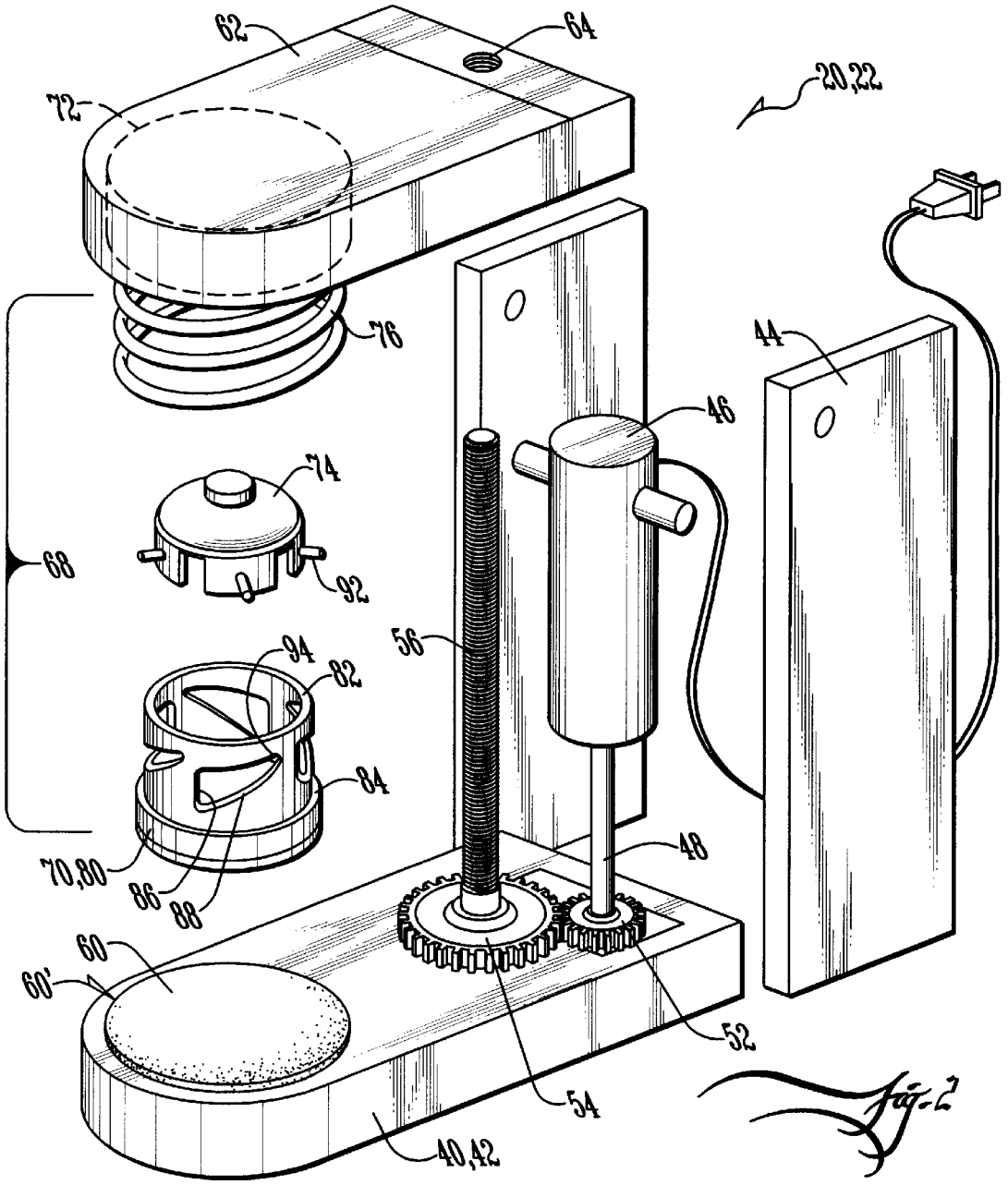
FIG. 2 is an exploded perspective view of the jar lid loosening device of FIG. 1.

FIG. 2 shows select components of the FIG. 1 motorized version of the jar lid loosening device 20, as in an exploded view. A stand 40 comprises a base 42 and a pair of side panels 44. The side panels 44 of the stand 40 support an electric motor 46 in an inverted position such that its chuck (not in view) is down and a drive shaft 48 inserted in the chuck extends down to terminate in a drive gear 52 disposed substantially on the plane of the base 42. The drive gear 52 meshes with a reduction gear 54, the axle 56 of which is a threaded rod. Trials with a proof-of-concept prototype used a motor scavenged from a ⅜ths-inch SKILL™ hand-drill, which motor included variable-speed forward and reverse. The motor 46 in the drawing includes a standard 110-VAC line cord 36 for plugging into a standard wall outlet (not shown). Control of the motor 46 is achieved by the three-way switch 38 shown in FIG. 1, including the previously mentioned safety switch 34 in the doors 26.

Portions of the base 42 act as the "passive jaw" 60. More particulary, the "passive jaw" portion 60 of the base 42 is defined simply by a circle of a non-slip mat 60 obtained from a planar span of neoprene rubber or the like, affixed tightly to the base 42. In spaced opposition to the passive jaw 60 is an overhead traveling head 62 which incorporates the "active jaw" 70. In assembly, the traveling head 62 is cantilevered from the threaded axle 56 by virtue of a threaded socket 64 in the traveling head 62. In the drawing, however the traveling head/threaded socket 62/64 is/are shown disengaged from threaded axle 56 for sake of clarity. Reversible rotation of the threaded axle 56 drives the traveling head 62 alternately UP or DOWN relative to the stationary passive jaw 60 to obtain the retraction and compression strokes respectively for the pair of jaws 60 and 70 of the device.

The traveling head 62 carries the active jaw 70 by means of a converter mechanism 68. The converter mechanism 68 operates such that an applied downward stroke is converted into a twisting motion. The converter mechanism 68 nests within an inverted well 72 in the traveling head 62. The converter mechanism 68 includes a drive sprocket 74 and an open-coil spring 76, as well as the active jaw 70.

Figure 3:
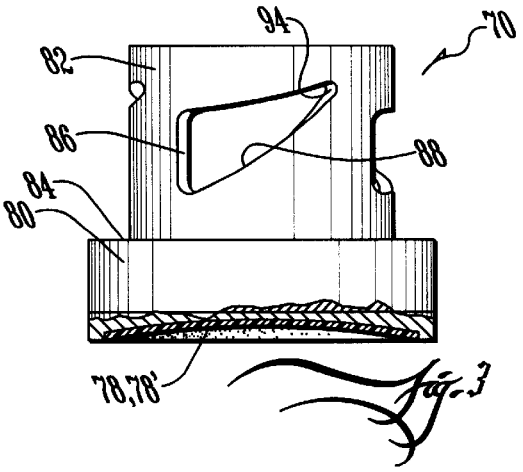
FIG. 3 is a front elevational view of the active jaw of FIG. 2, shown partially in section.

To turn more particularly now to the active jaw 70, FIG. 3 shows that the active jaw 70 comprises a spherical cap 78 formed into an enlarged disk portion 80, and appended onto the enlarged disk portion 80 is a hollow drum portion 82. The reduced-down diameter of the hollow drum portion 82 is delimited from the enlarged disk portion 80 by virtue of a shoulder 84. The hollow drum portion 82 is formed with a series of angularly-distributed cam slots 86. Each cam slot 86 includes a helical ramp portion indicated by reference numeral 88 in the drawing. The spherical cap portion 78 includes a non-slip liner 78' of neoprene rubber or the like to increase frictional grabbing between a lid 32 and the jaw 70.

Figure 4:
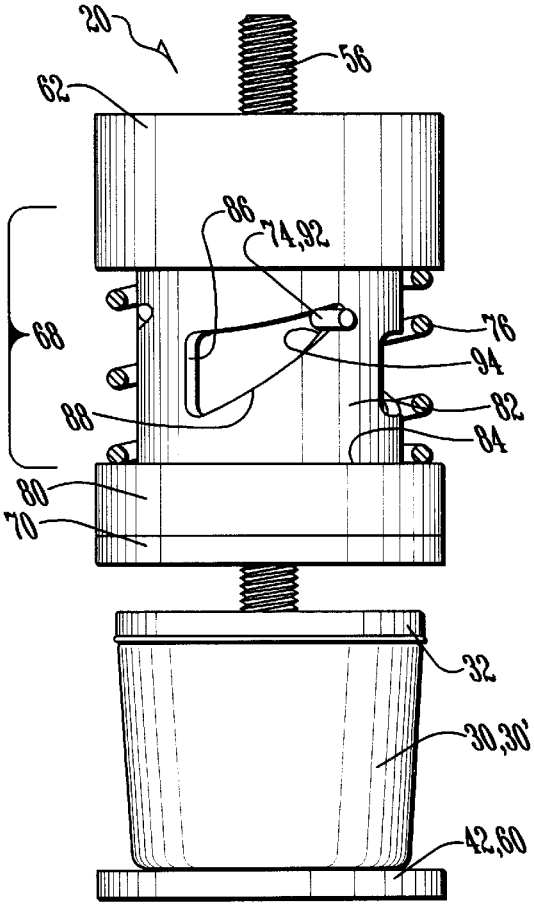
FIG. 4 is a front elevational view of the jar lid loosening device of FIG. 2, except re-assembled and shown at rest as between uses, with a lidded jar inserted between the retracted jaws in position for compression therebetween.

With general reference to FIGS. 2 and 4, the drive sprocket 74 has four stubby spokes 92 extending out from it. The drive sprocket 74 generally inserts and rests deposited in the center of the hollow drum section 82 of the active jaw 70. In fact, when deposited inside the drum portion 82, the drive sprocket 74 is situated such that its stubby spokes 92 insert and extend through the cam slots 86, as shown for example by FIG. 4. In use. the drive sprocket 74 is fastened fixed to the traveling head 62.

FIG. 4 shows the converter mechanism 68 completed and assembled to the traveling head 62. This can be achieved by the following sequence of steps (these are not illustrated). The drive sprocket 74 is inserted and preliminarily situated into the hollow drum portion 82 by manipulating the drive sprocket 74 such that, on an inclined angle-of-attack, two spokes 92 lead the way into their respective cam slots 86 as the other two trailing spokes don't slip into their cam slots 86 until the inclined sprocket is 92 leveled even with drum portion 82. The drum portion 82 is then inserted in one end of the open-coil spring 76 until that end of the spring 76 rests on the shoulder 84. The drum 82 (along with the spring 76 and sprocket 92) is telescoped into the well portion 72 of the traveling head 62. The spring 76 is compressed slightly as the sprocket 92 is fastened tight to the top of the traveling head 62.

In the end, the completed head 62 and converter mechanism 68 should appear as they do in FIG. 4. Each spoke 92 rests in a top corner 94 of its corresponding cam slot 86, which corresponds to the beginning of the ramp portion 88 thereof. The open-coil spring 76 is slightly compressed. The drive sprocket 74 is fastened stationary to the traveling head 62 but the drum portion 82 of the active jaw 70 is able to foreshorten or retreat up inside the inverted well 72:—but only against the compressive resistance of the spring 76.

Figure 5:
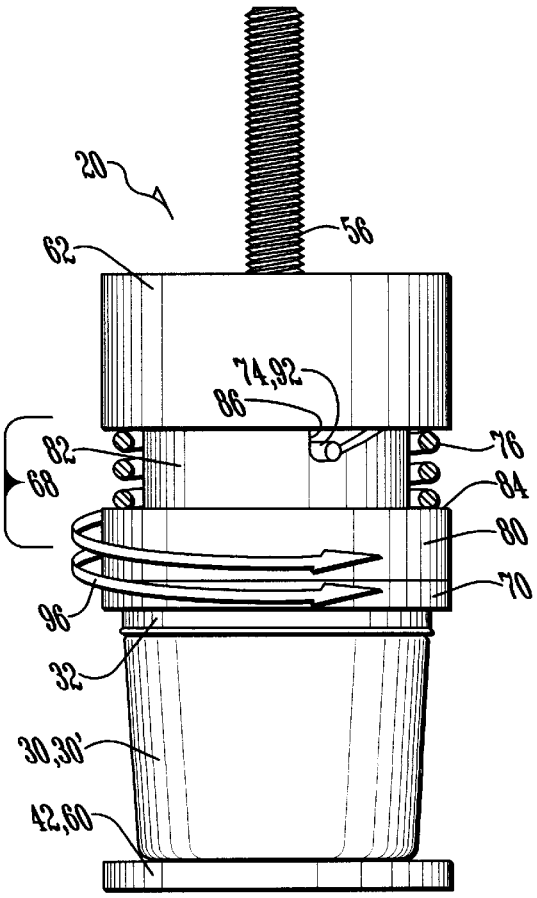
FIG. 5 is a front elevational view comparable to FIG. 4 except showing compression upon the lidded jar between the jaws, wherein active jaw operates to untwist the lid loose on the jar as indicated by the direction arrows.

FIG. 4 is representative of how things appear at the beginning of a compression stroke for the traveling head 62. A lidded jar 30 rests on the passive jaw 60. The active jaw 70 is sufficiently "retracted" or spaced above the lidded jar 30 such that as yet there is no contact between the active jaw 70 and the lid 32. In comparison, FIG. 5 shows the change in position of things far into the compression stroke (perhaps at or near the end). The traveling head 62 has traveled down sufficiently far such that the spherical cap 78 of the active jaw 70 has landed upon the lid 32 of the jar 30'. At the beginning of contact between the active jaw 70 and the lid 32 (contact at that very instance is not shown), the spokes 92 of the drive sprocket 74 had not yet changed position in their cam slots 86:—ie. the spokes 92 remained resting in the top corners 94 of the cam slots 86 comparably as shown by FIG. 4. However, as the traveling head 62 continued down, the active jaw 70 limited out at a given elevation against the lid 32. Henceforth the active jaw 70 could descend no more and the remainder of its actions transpire at such a given elevation. The drum portion 82 likewise holds level (relative to the given elevation determined by the lid 32) while the traveling head 62 continues down. In effect, the inverted well 72 begins to take in more of the drum portion 82 as the drum portion 82 is "shoved" further into (figuratively speaking) the well 72 of the traveling head 62. As the drum 82 was retreating further into the well portion 72, the spokes 92 of the drive sprocket 74 began riding down the helical ramp 88 of the cam slots 86 of the drum 82, inducing a counter-clockwise twisting motion in the active jaw 70. The open-coil spring 76 underwent both compression and torsional uncoiling in resistance to the retreat and twisting of the drum 82 within the well 72. Given the foregoing, the frictional grabbing between the lid 32 and spherical cap/liner 78/78' untwisted the lid 32 as indicated by direction arrows 96, and hence broke the lid 32 unstuck and loosened it.

As the compression stroke progressed as far as shown by FIG. 5, the lid 32 is untwisted a fraction of a turn. Actual trials prove, however, that such a fraction of a turn is sufficient to loosen most if not all the lids tested to date.

At the end of the compression stroke, the spring 76 is compressed such that it applies about sixty pounds (27 kg) of force onto the lidded jar 30. This provides sufficient frictional grabbing between the passive jaw 60 and jar 30', and active jaw 70 and jar lid 32. to accomplish the objects of the invention:—namely, hold the jar 30' still as the lid 32 is loosened unstuck. At the end of the compression stroke, the operator reverses operation of the motor 46 by means of the control switch 38 (see, eg., FIG. 1) and hence causes retraction the traveling head 62 in the direction of UP. The torsional recoiling of the spring 76 causes the active jaw 70 to re-tighten the lid 32 slightly, undoing some of the loosening work done by the compression stroke. Nevertheless, the lid 32 remains substantially loosened. Once the traveling head 62 travels UP sufficiently to lift the active jaw 70 off the lid 32, the jar 30 can be manually removed from between the jaws 60 and 70 and thereafter untwisted by hand with ease.

It has been discovered that for short jars, propping them up on a short non-slip platform (not shown) to elevate their lids nearer the active jaw 70 is advantageous for reducing the stroke of the traveling head 62. Although such a short platform provides the mentioned advantages, it is also not necessary.

Figure 7:
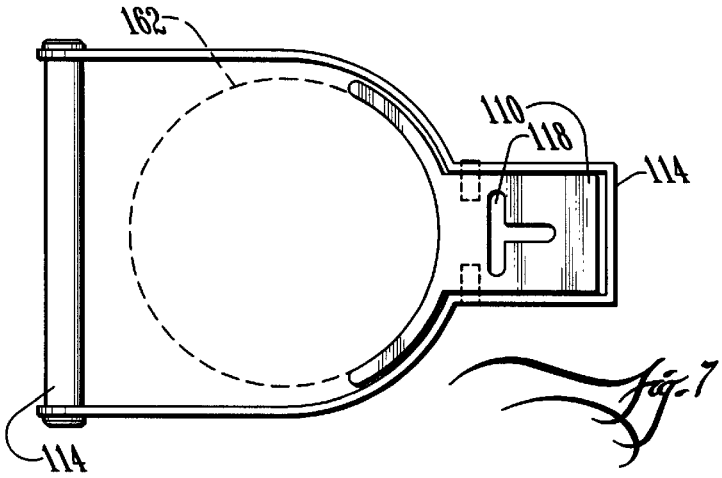

FIGS. 6 and 7 show the hand-jack version 100 of the jar lid loosening device. Briefly, the threaded axle 56 and motor 46 of the FIG. 2 version 20 have been replaced by a jack stand 140. This kind of hand jack 140 shares several general features in common with a common variety of car jack.

More particularly, the jack stand 140 includes a base 142 on which is anchored a T-bar stanchion 156. The stem edge 156' is serrated with teeth. A ratchet housing 110 as shown by FIG. 7 has a T-shaped slot 118 in it through which is inserted the T-shaped cross-section of the T-bar stanchion 156. The ratchet housing 110 carries a conventional ratchet mechanism 112 except that—whereas in the field of car jacks such ratchet mechanisms are disposed to provide power for lifting a car UP—the ratchet mechanism 112 is inverted such that its power stroke is in the DOWN direction. A yoke handle 114 shaped as shown by FIG. 7, flanks the ratchet housing 110 as well as the traveling head 162. In use, manually pumping the handle 114 up and down drives the ratchet mechanism 112 as well as the attached traveling head 162, in the DOWN direction. A toggle 116 allows reversing the ratchet mechanism 112 such that manually pumping the handle 114 up and down drives the ratchet mechanism 112 as well as the attached traveling head 162, in the UP direction, or in the direction of retracting the active jaw 170 off the jar lid 32 (such a sequence of action(s) is not illustrated in FIG. 6).

Another difference between the FIG. 1 version 20 and the FIG. 6 version 110 of the jar lid loosening device relates to the converter mechanism 168. Basically, the drive sprocket 74 of FIG. 2 has been obviated in favor of forming spokes 192 directly on the active jaw 170 as well as forming the mating cam slots 186 directly in a cylindrical skirt portion 172' of the traveling head 162.

That is, more particularly, the active jaw 170 comprises an spherical cap portion 178 lined on the underside with a non-slip liner such as of neoprene rubber or the like. Appended to the top of the spherical cap 178 is a short guide shaft 182. The traveling head 162 has a cylindrical skirt portion 172' which correspondingly defines the inverted well portion 172 of the traveling head 162. The cam slots 186 are formed directly in this skirt portion 172' of the traveling head 162, but the cam slots 186 otherwise generally have the same overall shape as their FIGS. 2–5 counterparts 86 formed in the drum 82. The crucial distinction in FIG. 6 is, however, that the cam slots 86 are inverted to how the cam slots 86 appear in FIGS. 2–4. That is, the spokes 192 normally rest in bottom corners (not indicated) in cam slots 186, and ride on helical edges which define the top edge (and not the bottom) of the cam slot 186.

Continuing in FIG. 6, the spherical cap 178 of the active jaw 170 is formed with a series of peripheral spokes 192 which insert into and cooperate with the corresponding cam slots 186 of the traveling head 162 much the same way as has been correspondingly described above in connection with FIGS. 2–5. An open-coil spring 176 is still included in the FIG. 6 version 100 of the jar lid loosening device however the spring 176's shape has been changed to a pyramidal format for stability's sake. The actions and operations of this arrangement of the converter mechanism 168 otherwise substantially follow and correspond to what has been described above in connection with its FIGS. 2 and 4–5 counterpart indicated by reference numeral 68 in those drawings.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

I claim:

1. A jar lid loosening device comprising:

a base, a traveling head, and upright carrier means attached to the base for carrying the traveling head for axial cycles of compression and retraction strokes;

a source of power to power the traveling head through at least the compression stroke;

a pair of jaws arranged to compress upon a lidded jar inserted therebetween, wherein one of said jaws is a passive jaw that is fixed substantially stationary relative to the base, the other being an active jaw that is spaced above and linked to the traveling head; and, a converter mechanism linking the active jaw to the traveling head and harnessing the traveling head's compression stroke as a drive input for conversion into a twisting motion in the active jaw such that generally, the active jaw rides along inactively with the traveling head as the traveling head powers through a given compression stroke except that, if a lidded jar is inserted between the jaws as set on the passive jaw, then as the active jaw eventually limits out against the lidded jar during the given compression stroke, from that stage on, the active jaw is driven by the converter mechanism to un-twist the jar and lid sufficiently loose until the device-loosened lid may be handily removed after that.

2. The jar lid loosening device of claim 1 wherein the converter mechanism comprises an arrangement having an operative engagement between at least one abutment and at least one inclined ramp.

3. The jar lid loosening device of claim 2 wherein the converter mechanism further includes an open coil compression spring loaded between the active jaw and traveling head to oppose both axial and torsional changes in relative position therebetween.

4. The jar lid loosening device of claim 1 wherein the converter mechanism comprises, in combination, configuring the traveling head non-rotatably with one of abutments or complementary inclined ramp-ways, configuring the active jaw with the other of said abutments or complementary inclined ramp-ways, and arranging the abutments to engage the inclined ramp-ways such that, at the stage of the given compression stroke when the active jaw limits out against the lidded jar, further compressive travel of the traveling head applies a force to the active jaw.

5. The jar lid loosening device of claim 4 wherein one of the traveling head or the active jaw includes a cylindrical sleeve, and said inclined ramp-ways are formed in this cylindrical sleeve such that the inclined ramp-ways generally trace helical arc segments.

6. The jar lid loosening device of claim 1 wherein the active jaw is recessed from below in the shape of a spherical cap for improving universal mating with a cylindrical rim of various sizes for variously-sized lidded jars.

7. The jar lid loosening device of claim 1 wherein one or both of the jaws incorporate a resilient outer layer to improve frictional gripping on lidded jars.

8. The jar lid loosening device of claim 1 wherein the upright carrier means includes an upright threaded drive rod, the source of power comprises an electric motor turning the threaded drive rod, and the traveling head includes a threaded socket for engaging the threaded drive rod.

9. The jar lid loosening device of claim 8 wherein the motor is reversible to allow powering of not only the compression strokes but also the retraction strokes.

10. The jar lid loosening device of claim 1 wherein the source of power comprises a hand jack attached to the traveling head, the upright carrier means comprises an upright stanchion for operative engagement by the hand jack, and the traveling head includes a socket for passage of the stanchion.

11. A jar lid loosening device comprising:

a pair of opposed jaws arranged to compress upon a lidded jar inserted therebetween;

a pair of corresponding opposed jaw-mounting structures therefor;

guide means extending between the opposed jaw-mounting structures for guiding and limiting the relative movement therebetween to be just along an axis for cycles of non-rotatable, axial compression and retraction strokes;

a source to power the jaw-mounting structures through the compression strokes;

wherein the pair of opposed a traveling jaw and a non-traveling jaw such that the non-traveling jaw and the mounting structure therefor are joined by means for inhibiting relative axial movement therebetween as the traveling jaw and mounting structure are joined by means for allowing resisted relative axial movement therebetween in opposition to a chosen applied resistance force;

wherein the pair of opposed jaws comprise a twisting jaw and a non-twisting jaw such that the non-twisting jaw and the mounting structure are joined by means for inhibiting relative rotation therebetween as the twisting jaw and mounting structure are joined by torsional means for allowing resisted relative rotation therebetween in opposition to a given applied resistance force;

the torsional means also linking the twisting jaw to the twisting jaw-mounting structure for utilizing the twisting jaw-mounting structure's compression stroke as a drive input for conversion into a rotational motion in the twisting jaw such that generally, the twisting jaw rides along at relative rest with the twisting jaw-mounting structure as the pair of opposed jaw-mounting structures power through an instance of a compression stroke except that, if a lidded jar is inserted between the jaws, then as the twisting jaw eventually limits out against the lidded jar during the instant compression stroke, from that stage on, the twisting jaw is driven by the torsional means to un-twist the jar and lid sufficiently loose until the device-loosened lid may be handily removed after that.

12. The jar lid loosening device of claim 11 wherein the torsional means comprises an arrangement having an operative engagement between at least one abutment and at least one inclined ramp.

13. The jar lid loosening device of claim 12 wherein said inclined ramp is formed in a cylindrical sleeve such that the inclined ramp generally traces a helical arc segment.

14. The jar lid loosening device of claim 11 wherein the torsional means further includes an open coil compression spring for providing the given applied resistance force to relative rotation between the twisting jaw and jaw-mounting structure therefor.

15. The jar lid loosening device of claim 11 wherein said non-traveling jaw and said non-twisting jaw are the same as said traveling jaw and said twisting jaw are the same.

16. A jar lid loosening device comprising:

a stationary base, a traveling head, and guide means attached to the base for guiding the traveling head for axial cycles of compression and retraction strokes;

a source of power to power the traveling head through at least the compression stroke;

a pair of jaws arranged to compress upon a lidded jar inserted therebetween, wherein one of said jaws is relatively lower and is fixed substantially stationary to the base, the other being an active jaw that is spaced above in the traveling head; and, a converter mechanism linking the active jaw to the traveling head and receiving all the power input thereto through the traveling head's compression stroke and converting that power input into a torsional motion in the active jaw such that generally, the active jaw rides along at rest with the traveling head as the traveling head powers through a given compression stroke except that, if a lidded jar is inserted between the jaws, then as active jaw eventually limits out against the lidded jar during the given compression stroke, from that stage on, the active jaw is driven by the converter mechanism to un-twist the jar and lid sufficiently loose until the device-loosened lid may be handily removed after that.

17. The jar lid loosening device of claim 16 wherein the converter mechanism comprises an arrangement having an operative engagement between at least one abutment and at least one inclined ramp.

18. The jar lid loosening device of claim 17 wherein said inclined ramp is formed in a cylindrical sleeve such that the inclined ramp generally traces a helical arc segment.

19. The jar lid loosening device of claim 16 wherein the converter mechanism further includes an open coil compression spring loaded between the active jaw and traveling head to oppose both axial and torsional changes in relative position therebetween.

20. The jar lid loosening device of claim 16 wherein the guide means includes an upright threaded rod, the source of power comprises an electric motor turning the threaded rod, and the traveling head includes a threaded socket for mating the threaded rod.

* * * * *